United States Patent [19]

Giacometti

[11] 4,343,162

[45] Aug. 10, 1982

[54] LOCK WITH A RESILIENT ELEMENT ACTING BOTH AS THE EJECTOR AND AS THE SLIDER RETURN SPRING, FOR BAGS, BRIEF-CASES, SHOULDER BAGS AND THE LIKE

[75] Inventor: Antonio Giacometti, Varese, Italy

[73] Assignee: Siac Industria Accessori Cavaria S.p.A., Italy

[21] Appl. No.: 203,801

[22] Filed: Nov. 3, 1980

[30] Foreign Application Priority Data

Dec. 24, 1979 [IT] Italy ..... 23475/79[U]

[51] Int. Cl.[3] ..... E05B 65/48

[52] U.S. Cl. ..... 70/67; 70/71; 292/175; 292/281; 292/DIG. 72

[58] Field of Search ..... 70/65, 64, 66, 67, 68, 70/69, 70, 71; 292/175, 281, DIG. 72

[56] References Cited

U.S. PATENT DOCUMENTS

| | | | |
|---|---|---|---|
| 2,717,795 | 9/1955 | Cheney | 70/67 |
| 3,186,198 | 6/1965 | Noerrenberg-Sudhaus | 70/67 |
| 3,527,067 | 9/1970 | Atkinson | 70/71 |
| 3,598,436 | 8/1971 | Scelba | 70/70 |

*Primary Examiner*—Robert L. Wolfe
*Attorney, Agent, or Firm*—Steinberg & Raskin

[57] ABSTRACT

The lock for bags, brief-cases, shoulder bags and the like comprises two components, one being provided with an eyelet, tooth or stirrup and fixed to the rotatable flap of the bag or the like, and the other being connected to the fixed part of this latter and provided both with an aperture into which said eyelet is inserted and a knob connected to a slider so as to be able to move this latter against a spring, in order to enable a slider appendix, which acts as the bolt and is located in a position corresponding with said aperture, to be withdrawn from the eyelet which is inserted into this latter and so enable the bag or the like to be opened. Opening is facilitated by resilient means which tend to eject the eyelet from the aperture into which it is inserted when the bag is closed. The spring and resilient means are replaced by a single resilient plate (11) comprising at one end ejector fingers (12) and at the other end an appendix (15) bent at an angle to the plane of the plate (11) and forming a resilient arm which acts on the slider (10), so acting as a return spring (FIG. 2).

2 Claims, 2 Drawing Figures

LOCK WITH A RESILIENT ELEMENT ACTING BOTH AS THE EJECTOR AND AS THE SLIDER RETURN SPRING, FOR BAGS, BRIEF-CASES, SHOULDER BAGS AND THE LIKE

DESCRIPTION

This invention relates to a lock for bags, brief-cases, shoulder bags and the like, of the type formed from two components, one being provided with an eyelet and fixed to the rotatable flap of the bag or the like, and the other being fixed to the fixed part of this latter and provided with a slot into which said eyelet is inserted, and also with a knob connected to a slider so as to be able to move this latter against a spring, generally a compression spring, in order to enable a slider appendix, which acts as the bolt and is situated in a position corresponding to said slot, to be withdrawn from the eyelet inserted into the slot, and thus enable the bag or the like to be opened, this opening being facilitated by the action of resilient means which tend to eject the eyelet from the slot into which it is inserted when the bag is closed.

In known locks of this type, the resilient ejector means are constituted by a suitably shaped resilient plate, whereas the spring which acts on the slider is a separate structural part, and is generally represented by a spiral spring.

The presence of the ejector plate and slider return spring leads on the one hand to all the disadvantages of having to produce, handle and assemble two pieces instead of one, and on the other hand to a difficult and laborious assembly of the spiral spring, requiring a certain manual ability.

The invention proposes a constructional simplification which obviates the aforesaid drawbacks, so that the lock becomes extremely simple to assemble.

According to the invention, the two resilient means of the conventional design are replaced by a plate comprising, at one end, ejector fingers which reach into the slot zone, and at the other end an appendix bent at an angle to the plane of the plate and forming a resilient arm which acts on the slider, so acting as a return spring.

If the lock comprises a head which is rotated by a key to prevent the lock being opened in a certain position, the plate comprises a hole in a position corresponding with the head in order to enable this latter to be rotated by a key.

The invention will be more apparent from the detailed description given hereinafter by way of example with reference to the accompanying drawing, in which.

Figure 1:
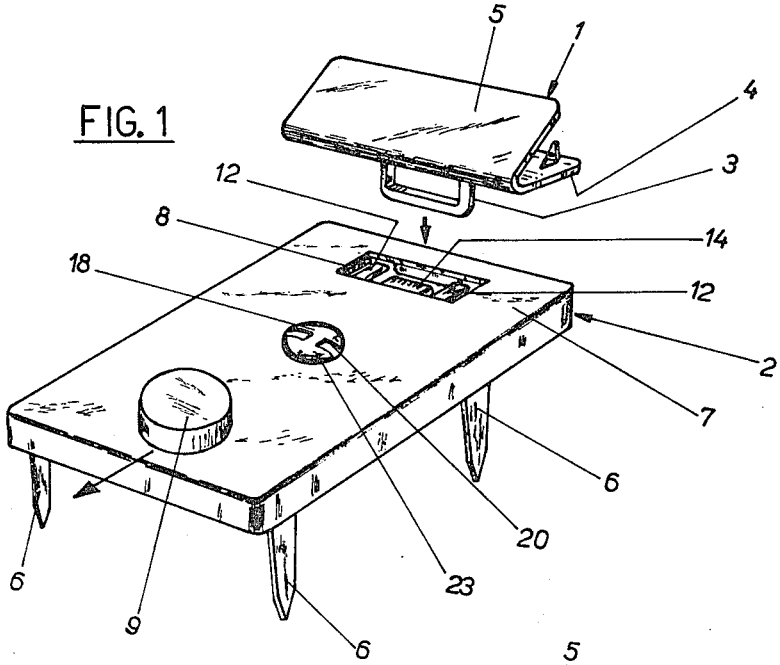
FIG. 1 is a perspective view of a lock for bags, brief-cases and the like according to the invention.
Figure 2:
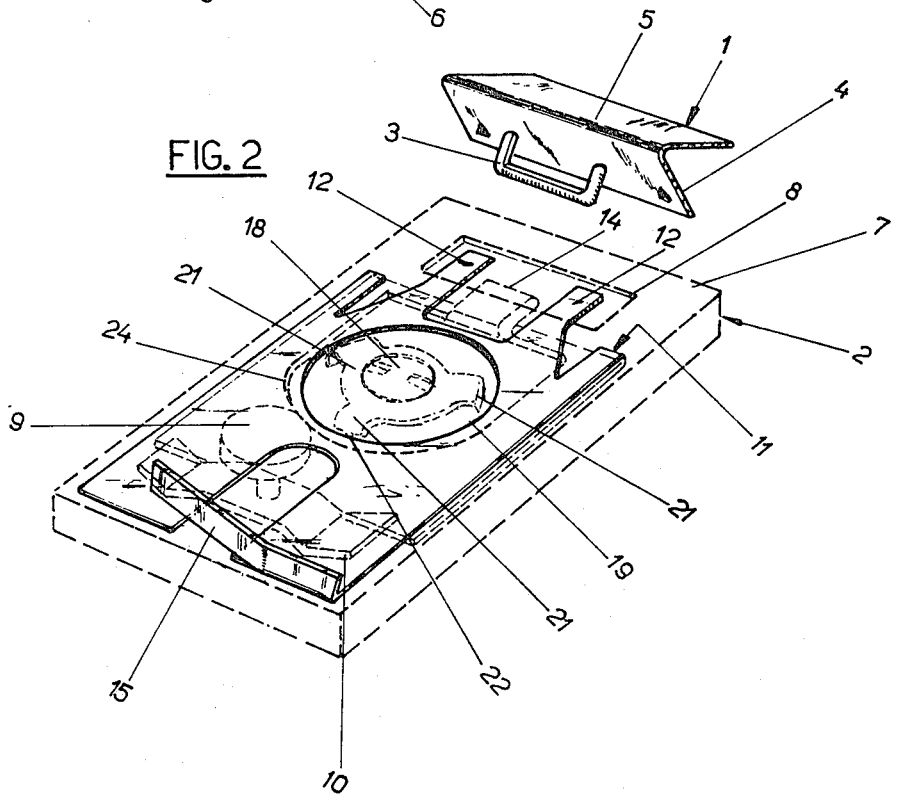
FIG. 2 is a perspective transparent view of the same lock, in which the plate constituting the characteristic part of the lock according to the invention is shown by full lines. In this figure the lower cover has been omitted for reasons of clarity.

With reference to the figures, the reference numerals 1 and 2 respectively indicate the two components of the lock. The component 1 is provided with an eyelet or stirrup 3, and comprises two flanges 4, 5, between which the mobile flap, not shown, of the bag, shoulder bag or the like is clamped in known manner. The component 2, which is to be connected to the fixed part of the bag or the like by means of bendable lancet-shaped lugs 6, comprises an inner cover, not shown, of which said lugs 6 form part, and an outer housing 7 to which the inner cover is fixed in any known manner, for example by bending the edges over. The housing 7 comprises an aperture or slot 8 into which the stirrup 3 is inserted in order to close the bag or shoulder bag, as indicated in FIG. 1. On the upper face of the housing 7 there is situated a knob 9 which can be moved in the direction of the arrow of FIG. 1, and is connected through a suitable slot (not shown) in the housing 7 to a slider 10. This latter is mounted slidable between a resilient metal plate 11 shown by full lines in FIG. 2, and the housing 7. The plate in this example is disposed between the slider 10 and said cover for the component 2. The plate is locked in situ either by virtue of the fixing between the cover and housing 2, or by any known means. The plate 11 comprises at its front a pair of resilient fingers 12, visible in the aperture 8, such that they become deflected when the stirrup 3 is inserted into this latter and they eject the stirrup when the knob 9 is moved in the direction of the arrow, and thus when the locking appendix 14 forming part of the slider 10 is withdrawn from the aperture 8 and from the stirrup 3 in which it is located. The movement of the slider 10 in the direction of the arrow is opposed by a return spring which, according to the invention, is constituted by an appendix 15 bent at an angle to the plane of the plate 11, of which it forms part, to form a resilient arm acting on the rear of the slider 10. The plate 11 comprises a hole 19 coaxial with the hole 20 present in the wall of the housing 7. The end of a rotatable locking head 18 extends slightly through the hole 20, and comprises three projections 21, one of which possesses a tooth which when the lock is in its open and closed position enters into one of two diametrically opposing notches (not shown) provided in the cover (also not shown). The hole 19 has a diameter greater than the projections 21 to enable the head 18 to be rotated, this rotation being performed by a key inserted into the head apertures 23.

The projections 21 are situated inside a profiled aperture 24 in the slider 10 to enable them to be rotated. In the position shown in FIG. 2, the slider 10 can be moved in the direction of the arrow, whereas when the projections assume a position rotated through 180° from the previous position, the slider 10 cannot be moved by the knob 9.

In conformity with the state of the art, it is apparent that the cover, not shown, will be shaped such that when fixed to housing 7 it holds together the internal parts, i.e. the plate 11, slider 10 and, if present, the locking head 18 in the required manner, while obviously allowing them the required freedom of movement. It is also apparent that the plate 11 can be disposed between the slider 10 and housing 7.

What we claim is:

1. A lock for bags, brief-cases, shoulder bags and the like, comprising two components, one being provided with an eyelet, tooth or stirrup and fixed to the rotatable flap of the bag or the like, the other being connected to the fixed part of this latter and provided both with an aperture into which said eyelet is inserted and a knob connected to a slider so as to be able to move this latter against a spring, in order to enable a slider appendix, which acts as the bolt and is situated in a position corresponding with said aperture, to be withdrawn from the eyelet which is inserted into this latter and so enable the bag or the like to be opened, the opening being facilitated by resilient means which tend to eject the eyelet from the aperture into which it is inserted when the bag is closed, wherein the spring and resilient means are replaced by a resilient plate (11) comprising at one end ejector fingers (12) and at the other end an appendix (15) bent at an angle to the plane of the plate (11) and forming a resilient arm which acts on the slider (10), so acting as a return spring.

2. A lock as claimed in claim 1, wherein the plate (11) comprises a hole (19) through which at least part of a rotatable head (18, 21) for locking the lock extends.

* * * * *